US006045203A

United States Patent [19]

Marks et al.

[11] Patent Number: 6,045,203

[45] Date of Patent: Apr. 4, 2000

[54] TRIM SYSTEM FOR A DISHWASHER TUB ASSEMBLY

[75] Inventors: Larry D. Marks; Geoffrey L. Dingler, both of St. Joseph, Mich.

[73] Assignee: Whirlpool Corporation, Benton Harbor, Mich.

[21] Appl. No.: 08/964,540

[22] Filed: Nov. 5, 1997

Related U.S. Application Data

[60] Provisional application No. 60/031,295, Nov. 18, 1996.

[51] Int. Cl.[7] ..... A47B 77/06; A47L 15/00

[52] U.S. Cl. ..... 312/228; 312/229; 312/296

[58] Field of Search ..... 312/228, 229, 312/296, 100, 101, 102; 134/200, 201; 52/716.8, 212; 49/490.1, 475.1

[56] References Cited

U.S. PATENT DOCUMENTS

| | | | |
|---|---|---|---|
| 2,997,750 | 8/1961 | Laster, Jr. | 52/212 |
| 3,059,299 | 10/1962 | Sarafinas . | |
| 3,458,241 | 7/1969 | Barnard et al. | 312/228 |
| 3,826,553 | 7/1974 | Cushing et al. | 312/229 X |
| 3,862,515 | 1/1975 | Baermann | 49/490.1 X |
| 3,883,993 | 5/1975 | Pullan | 49/490.1 |
| 3,958,369 | 5/1976 | Mathellier | 49/490.1 X |
| 4,344,365 | 8/1982 | Fritz et al. | 49/490.1 X |
| 4,432,166 | 2/1984 | Weimar . | |
| 4,936,331 | 6/1990 | Sunberg | 134/201 |
| 5,389,409 | 2/1995 | Iwasa et al. | 49/490.1 X |
| 5,622,018 | 4/1997 | Schiedegger | 52/212 X |
| 5,625,992 | 5/1997 | Strick et al. | 52/212 X |
| 5,787,660 | 8/1998 | Adams | 52/212 |

*Primary Examiner*—Peter M. Cuomo
*Assistant Examiner*—Hanh V. Tran
*Attorney, Agent, or Firm*—Joel M. Van Winkle; Thomas J. Roth; Robert O. Rice

[57] ABSTRACT

A trim assembly for a dishwasher tub having a U-shaped front flange disposed about a front opening. The front flange has radiused upper corners to minimize material stretching during tub forming. The trim assembly connects to the front flange of the tub and includes a pair of corner trim member, a plurality of straight trim members and a pair of tub trim spacers wherein the trim assembly forms a continuous frame of trim disposed about the peripheral edge of the front flange. The straight trim members frictionally engage the straight edge portions of the tub front flange. The pair of corner trim members snap connect to the tub flange upper corners such that the tub front flange is provided with square upper corners. The pair of bottom trim spacers are disposed at the bottom edges of the side trim members and complete the trim assembly. The bottom trim spacers function to deflect wash liquid running off from the dishwasher door back into the tub and serves as structural spacers in the tub support assembly.

18 Claims, 5 Drawing Sheets

TRIM SYSTEM FOR A DISHWASHER TUB ASSEMBLY

This application claims the benefit of U.S. Provisional Application Ser. No. 60/031,295 filed Nov. 18, 1996.

BACKGROUND OF THE INVENTION

The present invention is directed to a dishwasher tub assembly and more particularly to a trim system for a dishwasher tub.

Conventional dishwashers include a tub forming a dishwashing enclosure in which dishes are washed. Dishwasher tubs are formed either as a molded plastic part or as a metallic part. Metallic tubs may be formed from either cold rolled carbon steel, which must subsequently coated with a non rusting layer such as porcelain. Alternatively, it is known to form metallic tubs using stainless steel.

Typically, undercounter dishwasher are installed into a cabinet cavity provided in the cabinet configuration of a kitchen. The cavity is defined by a countertop and by cabinet side walls such that the cavity has a rectangular opening. Undercounter dishwasher tubs are designed such that they fit within the opening of the cavity. Moreover, dishwasher tubs are provided with a front flange having 90° square upper corners to match the square upper corners of the cavity opening. In this manner, when the dishwasher is correctly installed in the cabinet cavity, the front flange of the tub and the cavity opening are closely aligned to provide a finished appearance and to prevent access into the space between the outer surface of the dishwasher tub and the inner surface of the cabinet cavity.

The top and side walls of a metallic tub are conventionally formed from a single metallic sheet referred to as a tub wrapper. Unfortunately, as can be understood by one skilled in the art, bending a tub wrapper to provide a tub with rounded upper corners while at the same time attempting to provide a front flange having square upper corners results in relatively severe stretching of the metallic sheet at the corner flange locations.

Stainless steel tubs provide many advantages over plastic tubs and porcelain coated carbon steel tubs. Primary among these advantages is the non-staining, non-rusting properties of stainless steel. Stainless steel is also aesthetically appealing, providing an attractive, reflective surface. Unfortunately, the problem of severe stretching and material tearing at the corner flange location is particularly a problem in forming stainless steel dishwasher tubs. This is true in part because, due to the high cost of stainless steel, stainless steel tubs are typically formed from relatively thin material. Moreover, stainless steel is relatively non-ductile such that it is difficult to stretch and form stainless steel without tearing. Accordingly, to prevent corner flange tearing, stainless steel tubs are commonly formed with a front flange which has radiused upper corners, generally corresponding to the radius of the tub wrapper bend, to minimize the amount of material stretching.

To provide square upper corners on the front flange, some manufacturers have welded squared corner pieces onto the rounded flange corners of the tub. While this achieves a tub having a square cornered flange, welding corner pieces onto the tub flange has many disadvantage including relatively high cost, unattractive appearance and manufacturing complexity.

Accordingly, it would be an advantage in the art to provide a tub assembly which avoided material tearing at the front flange corners during forming while still providing a front flange having square upper corners to match the cabinet cavity opening without having to weld corner pieces onto the tub.

Another problem encountered in metallic dishwasher tubs is the presence of many sharp edges which may cause injury during installation and service. This problem is particularly acute in a stainless steel tub because of the use of relatively thin material to minimize cost. Accordingly, it would be an advantage in the art to provide a tub assembly which included a trim system to cover the sharp edges present along the front flange area of a dishwasher tub.

SUMMARY OF THE INVENTION

Accordingly, the present invention is directed toward a dishwasher tub and trim assembly including a tub having a U-shaped front flange disposed about the front opening. The front flange has radiused upper corners to minimize material stretching during tub forming. The trim assembly connects to the front flange of the tub and includes a pair of corner trim member, a plurality of straight trim members and a pair of tub trim spacers wherein the trim assembly forms a continuous frame of trim disposed about the peripheral edge of the front flange. The straight trim members frictionally engage the straight edge portions of the tub front flange. The pair of corner trim members snap connect to the tub flange upper corners such that the tub front flange is provided with square upper corners. The pair of bottom trim spacers are disposed at the bottom edges of the side trim members and complete the trim assembly. The bottom trim spacers function to deflect wash liquid running off from the dishwasher door back into the tub and serves as structural spacers in the tub support assembly.

DESCRIPTION OF THE PREFERRED EMBODIMENT

Figure 1:
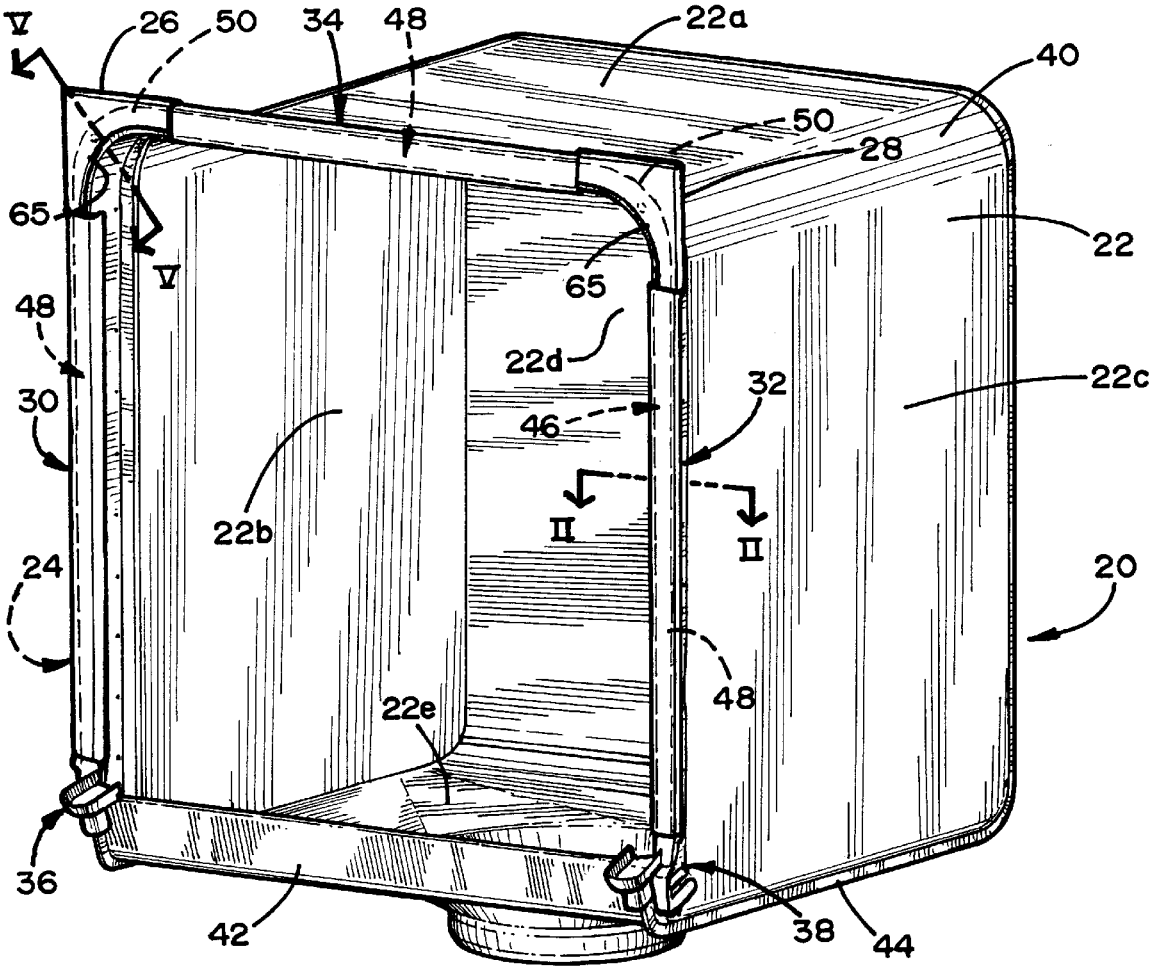
FIG. 1 is a perspective view of the tub and trim assembly of the present invention.

In FIG. 1, a dishwasher tub assembly 20 is shown including a tub 22 forming a dishwashing enclosure preferably formed from relatively thin sheets of stainless steel material. The tub includes a top wall 22*a*, side walls 22*b* and 22*c*, a back wall 22*d* and a bottom wall 22*e*. The top wall 22*a* and side walls 22*b* and 22*c* are formed by a U-shaped tub wrapper 40. The back wall 22*d* and bottom wall 22*e* are formed by an L shaped rear panel 42. The tub wrapper 40 and the rear panel 42 are joined along joint flange 44 by a joining means such as welding.

The tub includes a front opening defined by the front edge of the tub wrapper 40. A front flange 46 is provided about front opening of the tub 22. The front flange 46 is generally U-shaped having three straight flange portions 48 and a right hand and a left hand corner flange portion 50.

The tub assembly 20 further includes a front flange trim assembly 24 mounted to the front flange 46. The trim assembly includes a pair of corner trim members 26 and 28, a pair of straight side trim members 30 and 32, a straight top trim member 34, and a pair of tub trim spacers 36 and 38.

Each of the straight trim members 30, 32 and 34 is formed as an elongated, resilient plastic member which snap connects to the straight flange portions 48 of the front flange 46. The trim members 30, 32 and 34 are identical in length and cross-section and can be readily interchanged to simplify the manufacturing process.

Figure 2:
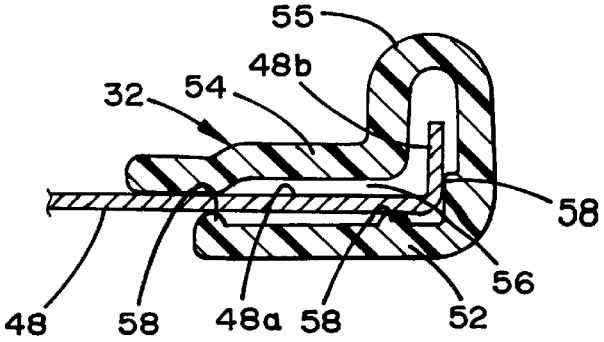
FIG. 2 is a sectional view taken along lines II—II of FIG. 1.

Turning to FIG. 2, which is illustrative of the cross-sectional details of each of the straight trim members 30, 32 and 34, it can be see that the straight trim member 32 has a first L-shaped wall 52 and parallel, facing second L-shaped wall 50 longitudinally joined along a radiused center portion 55 such that an elongated cavity having an L-shaped cross-section 56 is defined between the L-shaped walls 52 and 54. Inwardly protruding from the first L-shaped wall 52 are a plurality of interference ridges 58. During assembly of the straight trim members 30, 32 and 34, the L-shaped walls 52 and 54 are flexed apart to snap over the straight front flange portions 48. The straight flange portions 48 of the front flange 46 include a first portion 48*a* bent outwardly from the tub and a bent back portion 48*b*. Part of the first portion 48*a* and bent back portion 48*b* of the straight front flange portions 48 are received into the L-shaped opening 56 wherein the interference ridges 58 and the opposing L-shaped wall 54 grip the straight front flange portion 48 such that the straight trim members 30, 32 and 34 are securely fastened to the tub 22.

Figure 3:
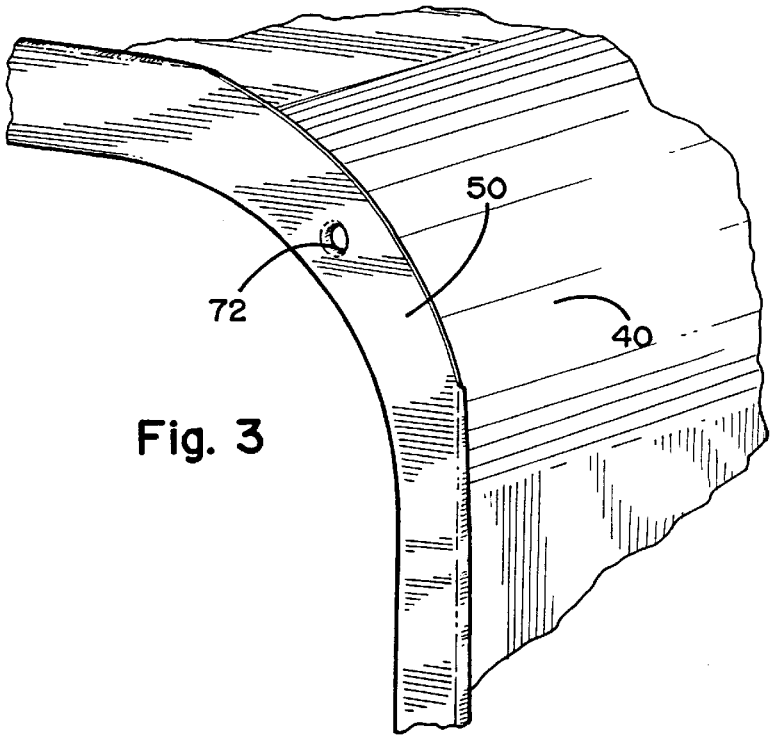
FIG. 3 is a perspective view of the right hand upper corner portion of the tub front flange without the trim assembly.

As discussed above, the front flange includes corner flange portions 50. FIG. 3 illustrates the top right hand corner of the front flange 46. To prevent corner flange tearing, the corner portions 50 of the front flange 46 are formed having a large radius generally corresponding to the bend radius of the tub wrapper 40 to minimize the amount of material stretching. Moreover, the corner portions 50 do not include any bent back portion corresponding to the configuration of the straight flange portions 48. Each corner portion 50 has an extruded hole 72 formed thereon.

The radiused corner construction presents a problem, as discussed above, in that the cabinet opening into which the dishwasher tub 22 is received during installation typically has square upper corners. Preferably, the front flange 46 of the tub matches the outline of the cavity opening. Accordingly, the corner trim members 26 and 28 are attached to the corner flange portions 50 to provide the tub flange with square upper corners.

Figure 4:
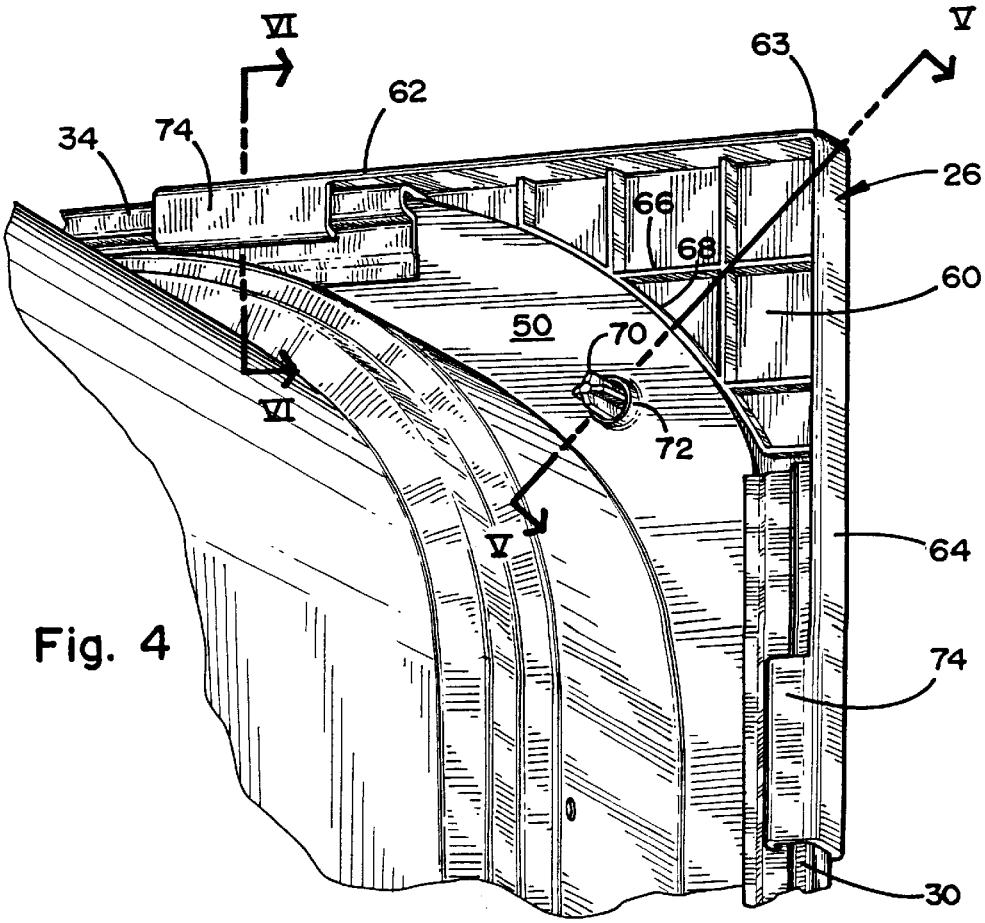
FIG. 4 is a rear perspective view of the upper left corner of the tub and trim assembly of the present invention.
Figure 5:
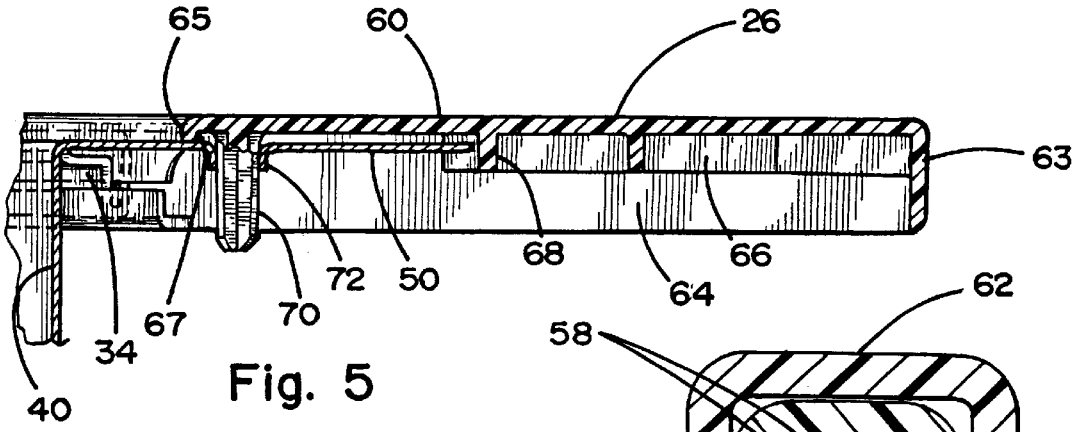
FIG. 5 is a sectional view taken along lines V—V of FIG. 4.
Figure 6:
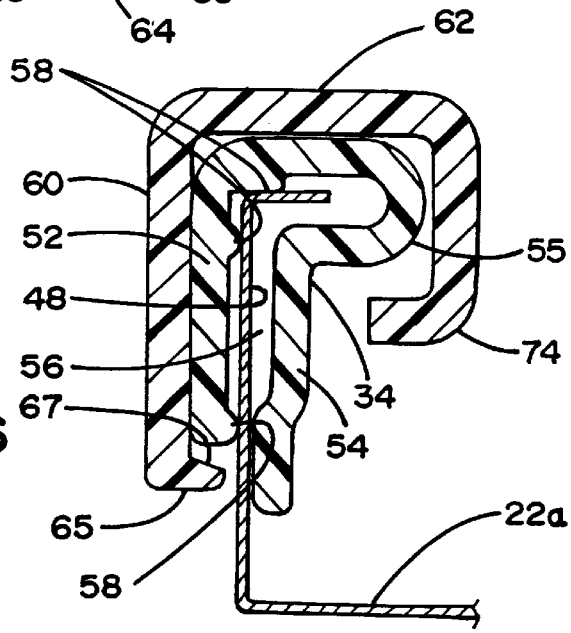
FIG. 6 is a sectional view taken along lines VI—VI of FIG. 4.

Details of the corner trim members 26 and 28 are illustrated in FIGS. 4–6. The corner trim members are designed to be symmetric about a center line wherein the right and left corner trim members are identical. For simplicity purposes, the following description refers only to the left hand corner trim member 26 but the details disclosed apply to both the right and left corner trim members 26 and 28.

In FIGS. 4 and 5, it can be seen that the corner trim 26 includes a web portion 60 extending between a top wall 62 and a side wall 64 wherein the top and side walls 62 and 64 are joined at a center portion 63 along one end and extend at approximately 90° from each other such that the corner trim member 26 has a generally triangular shape. The web portion 60 includes a radiused edge 65 generally corresponding to the corner bend radius of the tub wrapper 40 and extending between the top and side walls 62 and 64. A front lip 67 is provided along the radiused edge 65. The back surface of the web portion 60 may be partially reinforced with ribs 66 including a curved rib 68 corresponding to the radius of the corner flange portion 50. A mounting boss 70 extends from the web portion 60 of the corner trim member.

When the corner trim member 26 is assembled to the corner flange portion 50, the mounting boss 70 is received into the extruded hole 72 formed into the corner portion 50. Moreover, the top wall 62 extends along the top edge of the flange and the side wall 64 extends along the side edge of the flange wherein the walls 62 and 64 overlay the top trim member 34 and the side trim member 30, respectively, as shown in FIG. 6. Each wall 62 and 64 includes a retention rib 74 extending perpendicularly from the wall, facing the web portion 60 such that a resilient channel portion is formed along each wall 62 and 64. The channel portions snap fit over the radiused center portion 55 of the trim members 30 and 34 when the corner trim member 26 is connected to the front flange corner. As shown in FIG. 6, the portion of the trim members 34 which extends under the corner trim member 26 is captured between the web portion 60 and the tub flange 48 with the front lip 67 extending beyond the terminal edge of the trim member 34.

As discussed above, tub trim spacers 36 and 38 are attached to the tub adjacent the bottom edges of the side trim members 30 and 32. The tub trim spacers 36 and 38 are mirror image parts and for simplicity purposes, like the discussion of the corner trim members above, the below description will refer to only the right hand tub trim spacer 38.

Figure 7:
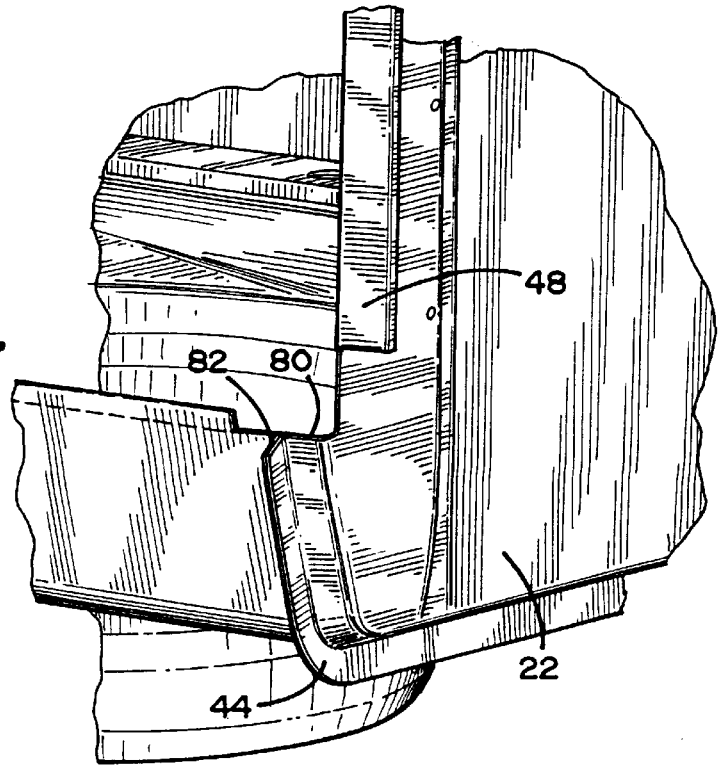
FIG. 7 is a front perspective view of the right hand lower corner portion of the tub front flange without the trim assembly.
Figure 8:
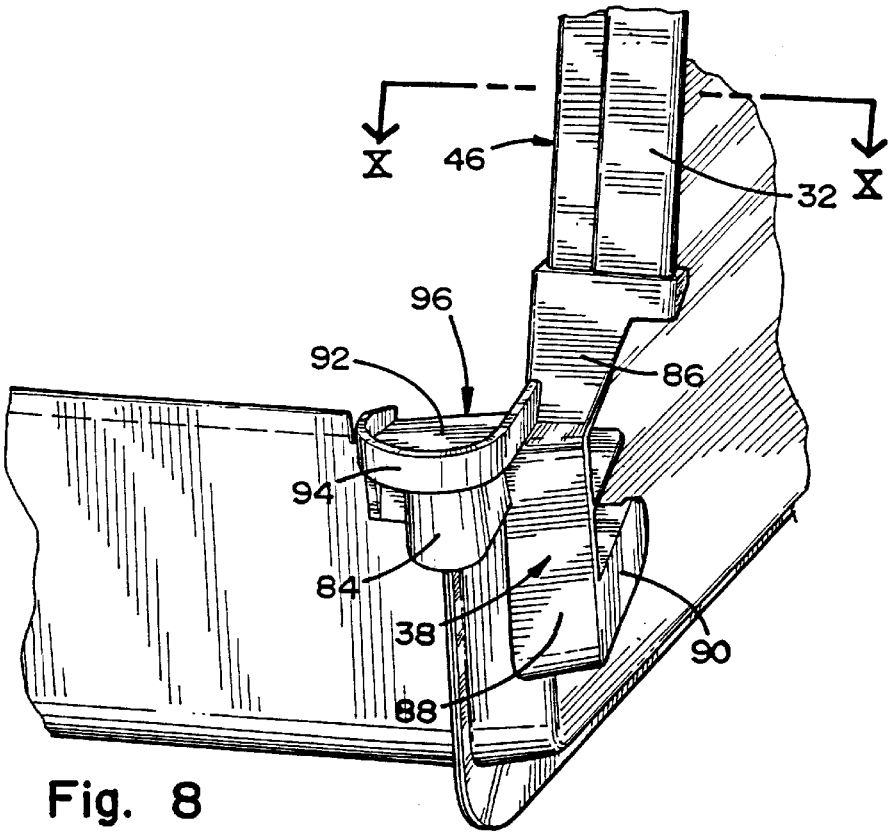
FIG. 8 is a front perspective view of the right hand lower corner portion of the tub front flange with the trim assembly in position.

FIG. 7 illustrates the bottom right hand portion of the tub 20 prior to assembly the trim assembly to the tub. It can be seen that the terminal edge 82 of the joint flange 44 is disposed in the bottom corner region 80 of the tub opening. FIG. 8 shows the lower trim spacer 38 assembled into the bottom corner 80 of the tub, covering the bottom edge of the front flange and the terminal edge 82 of the joint flange 44.

The lower trim spacer 38 includes a center portion 84, an upwardly extending portion 86 for covering the bottom edge of the front flange and a downwardly extending spacer portion 88. The center portion 84 fits over the terminal edge 82 of the joint flange 44 and includes a sloped wall 92 having a U-shaped rim 94. The wall 92 and U-shaped rim 94 form a deflector cup 96 for receiving wash liquid which may run off a dishwasher door 104 (FIG. 9) and directing this door run-off liquid back into the dishwasher tub. The spacer portion 88 of the trim spacer 38 extends includes a spacer surface 90 extending downwardly along the side wall of the tub 22.

Figure 9:
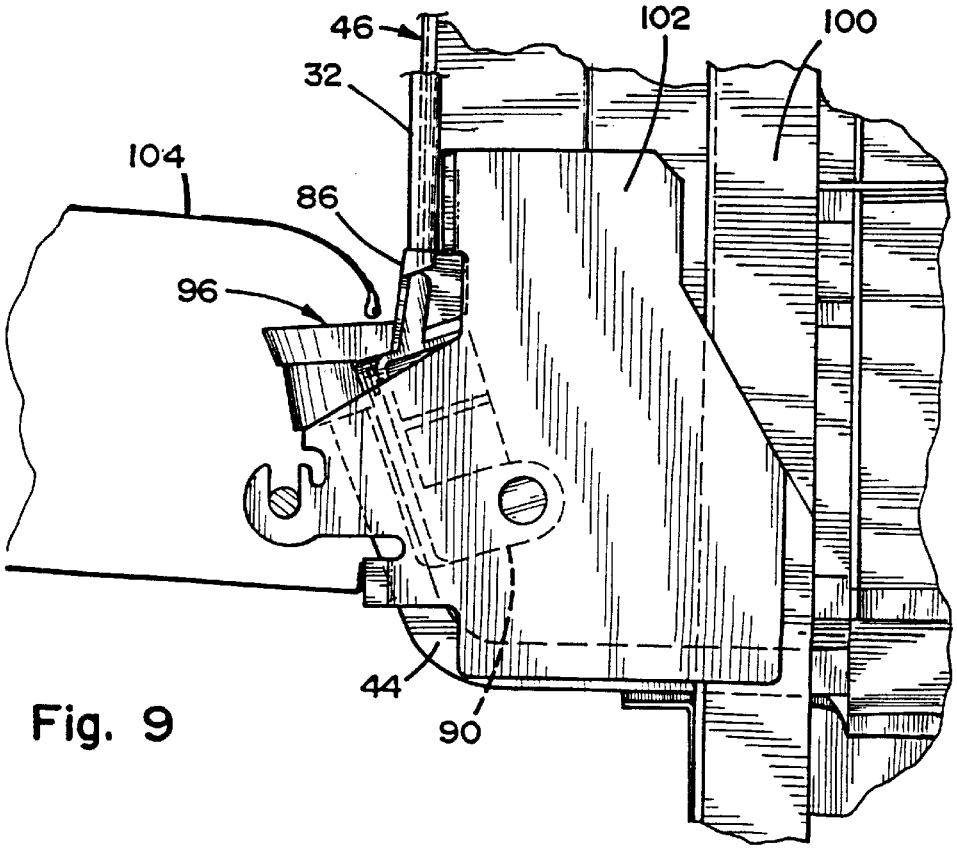
FIG. 9 is a side, elevational view of the right hand lower corner portion of the tub including a tub support member and hinge bracket.
Figure 10:
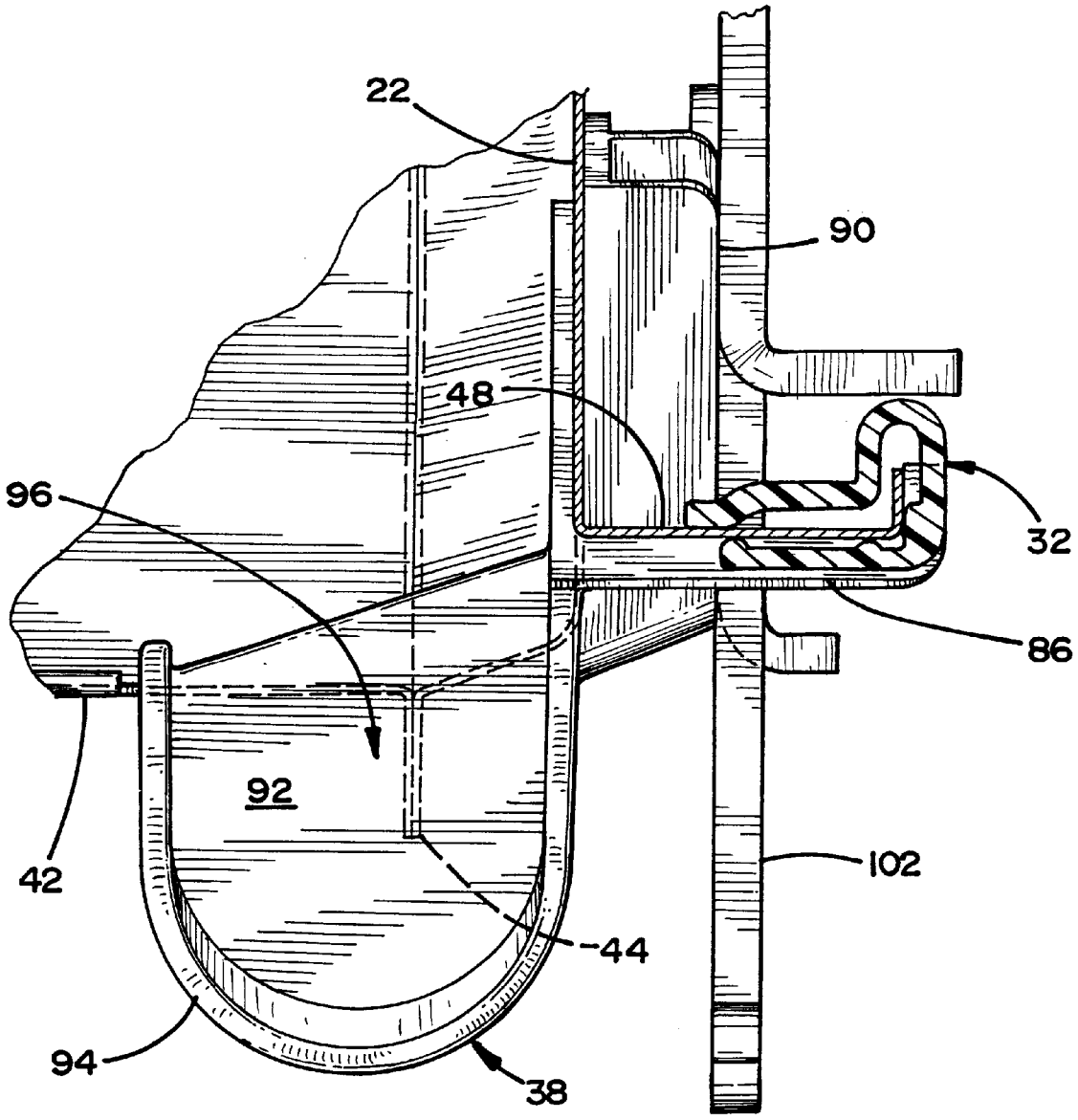
FIG. 10 is a sectional view taken along line X—X in FIG. 8.

As shown in FIGS. 9 and 10, during subsequent assembly a support collar 100 to the tub 22, as shown and described in U.S. Pat. No. 4,746,177 herein incorporated by reference, the spacer surface 90 is captured between the tub side wall and a hinge bracket 102 extending from the support collar 100. In this manner, the hinge bracket 102 is spaced away from the tub side wall and prevented from bending inward in a manner which may cause assembly difficulties.

It can be understood, therefore, that each of the lower trim spacers 36 and 38 serves several functions. Firstly, the lower trim spacers cover the sharp edges of the bottom corner region 80 of the tub opening and complete the trim assembly 24 in an aesthetically pleasing manner. Secondly, the lower trim spacers 36 and 38 function as deflectors for directing wash liquid, which may run off the dishwasher door, back into the dishwasher tub. Finally, the trim spacers 36 and 38 serve a structural purpose by spacing the tub support member away from the tub side wall.

The above description illustrates the many benefits of the present invention. The described dishwasher tub trim assembly provides a peripheral edge for covering the sharp edges of the dishwasher tub flange 46. Moreover, square upper corners may be provided on a tub in an economical and aesthetically pleasing manner such that the dishwasher tub flange matches the cabinet cavity opening into which the dishwasher will be installed. Finally, the bottom trim spacers of the trim assembly serve to deflect wash liquid running off from the dishwasher door back into the tub and spaces the tub support collar away from the tub.

While the present invention has been described with reference the above described embodiments, those of skill in the Art will recognize that changes may be made thereto without departing from the scope of the invention as set forth in the appended claims.

We claim:

1. A dishwasher tub assembly, comprising:

a tub forming a dishwashing enclosure having a front opening, the tub having a front flange disposed about the front opening forming a front surface of the tub, the front flange having a generally inverted U shape and upper corner portions wherein each of the upper corner portions have a non-square, radiused outer edge; and a pair of corner trim members removably connected to the tub flange upper corner portions wherein the corner trim members form substantially square upper corners on the front flange.

2. The dishwasher tub assembly of claim 1, further wherein the corner trim members snap connect to the tub flange upper corner portions.

3. The dishwasher tub assembly according to claim 1, wherein each of the corner trim members include at least one resilient channel for snap fitting over the front flange.

4. The dishwasher tub assembly of claim 1, further wherein the front flange includes a top edge disposed between the upper corners and opposite side edges, and wherein each of the corner trim members further comprise:

a first elongated wall having a first end;

a second elongated wall extending perpendicularly away from the first end of the first elongated wall;

a web portion extending between the first elongated wall and the second elongated wall, wherein when the corner trim members are assembled to the upper corners of the front flange, the first elongated wall extends along the top edge of the flange and the second elongated wall extends along the side edge of the flange.

5. The dishwasher tub assembly according to claim 4, further wherein each of the upper corners of the flange includes a mounting hole and each of the corner trim members includes a mounting boss extending outwardly from the web portion such that during assembly of a corner trim member to one of the upper corners of the front flange the mounting boss of the corner trim member is received into the mounting hole.

6. The dishwasher tub assembly of claim 1, further wherein the front flange has a top edge disposed between the upper corners and opposite side edges, the dishwasher tub assembly further comprising:

a plurality of straight trim members connecting to the top and side edges of the front flange, wherein the corner trim members and the straight top and side trim members form a continuous frame of trim disposed about the peripheral edge of the front flange.

7. The dishwasher tub assembly according to claim 6, wherein each of the corner trim members include at least one resilient channel for snap fitting over one of the straight trim members.

8. The dishwasher tub assembly according to claim 6, wherein the straight trim members frictionally engage the front flange and each of the corner trim members snap connect to adjacent portions of the trim members.

9. The dishwasher tub assembly according to claim 1, further comprises:

a top flange portion having a substantially straight, horizontal outer edge, a first side flange portion having a substantially straight, vertical outer edge, a second side flange portion having a substantially straight, vertical outer edge, a first corner portion disposed between the top flange portion and the first side flange portion having a radiused outer edge, and a second corner portion disposed between the top flange portion and the second side flange portion having a radiused outer edge.

10. A dishwasher tub assembly, comprising:

a metallic tub having a substantially rectangularly shaped front opening, the front opening including a top edge, a bottom edge, a first side edge and a second side edge, the dishwasher tub front opening further including a right bottom corner and a left bottom corner, the tub further having a front flange disposed about the top and side edges of the tub front opening for forming a front surface of the tub, a door hingedly connected to the tub for closing the front opening of the tub;

a left tub trim spacer connected to the left bottom corner of the tub opening and fitting over at least part of the bottom edge of the tub opening for covering sharp edges, the left tub trim spacer having a surface for deflecting liquid dripping from the door into the tub when the door is open; and a right tub trim spacer connected to the right bottom corner of the tub opening and fitting over at least part of the bottom edge of the tub opening for covering sharp edges, the right tub trim spacer having a surface for deflecting liquid dripping from the door into the tub when the door is open.

11. The dishwasher tub according to claim 10, wherein the front flange of the dishwasher tub has a right corner flange portion and a left corner flange portion, the tub further comprising:

a left corner trim member attached to the left corner flange portion; and a right corner trim member attached to the right corner flange portion.

12. The dishwasher tub assembly of claim 11, further comprising:

a straight top trim member connected to the top edge of the front flange;

a left straight side trim member connecting to the left side edge of the front flange; and a right straight side trim member connecting to the right side edge of the front flange, wherein the corner trim members and the straight top and side trim members form a continuous frame of trim disposed about the peripheral edge of the front flange.

13. The dishwasher tub assembly of claim 12, further wherein each of the straight side trim members and the straight top trim member are identical parts, each comprising an elongated body having a pair of opposed L-shaped walls longitudinally joined along a radiused center portion such that an elongated cavity having an L-shaped cross-section is formed within each straight trim member.

14. The dishwasher tub assembly of claim 11, wherein each of the corner trim members further comprise:

a first elongated wall having a first end;

a second elongated wall extending perpendicularly away from the first end of the first elongated wall;

a web portion extending between the first elongated wall and the second elongated wall, wherein when the corner trim members are assembled to the upper corners of the front flange, the first elongated wall extends along the top edge of the flange and the second elongated wall extends along the side edge of the flange.

15. The dishwasher tub assembly according to claim 14, further wherein each of the upper corners of the flange includes a mounting hole and each of the corner trim members includes a mounting boss extending outwardly from the web portion such that during assembly of a corner trim member to one of the upper corners of the front flange the mounting boss of the corner trim member is received into the mounting hole.

16. The dishwasher tub assembly of claim 10, further wherein the tub flange upper corners are radiused and the corner trim members form substantially square upper corners on the front flange.

17. The dishwasher tub assembly according to claim 10, wherein the dishwasher tub further comprises a support structure including a pair of hinge brackets extending outwardly, normal to the plane established by the dishwasher front opening, wherein each of the tub trim spacers further comprises:

a spacer portion extending between the hinge bracket and tub.

18. A dishwasher tub assembly comprising:

a tub having a substantially rectangular front opening including a right bottom corner and a left bottom corner, the front opening including top edge, a bottom edge, a first side edge and a second side edge;

a U-shaped support structure supporting the tub and including a right hinge bracket and a left hinge bracket disposed adjacent to the bottom corners of the front opening, each of the hinge brackets extending outwardly, normal to the plane established by the dishwasher front opening;

a left tub trim spacer connected to the left bottom corner of the tub opening and fitting over at least part of the bottom edge of the tub opening, the left tub trim spacer having a spacer portion extending between the left hinge bracket and tub; and a right tub trim spacer connected to the right bottom corner of the tub opening and fitting over at least part of the bottom edge of the tub opening, the right tub trim spacer having a spacer portion extending between the right hinge bracket and the tub.

* * * * *